United States Patent [19]

Kemnitz et al.

[11] Patent Number: 4,625,394

[45] Date of Patent: Dec. 2, 1986

[54] BLANKET WIRE INSERTION MACHINE

[75] Inventors: Glen Kemnitz, Laurel; Richard H. Williams, Waynesboro, both of Miss.

[73] Assignee: Sunbeam Corporation, Oak Brook, Ill.

[21] Appl. No.: 783,973

[22] Filed: Oct. 3, 1985

[51] Int. Cl.[4] ..... H05B 3/54

[52] U.S. Cl. ..... 29/611; 29/729; 29/241; 29/433; 219/212; 219/528; 219/529; 254/134.3 FT

[58] Field of Search ..... 29/241, 453, 611, 613, 29/729, 760; 219/212, 528, 529; 254/134.3 FT

[56] References Cited

U.S. PATENT DOCUMENTS

| | | | |
|---|---|---|---|
| 1,058,825 | 4/1913 | Whittlesey | 219/212 |
| 2,491,776 | 12/1949 | Skelton | 29/241 |
| 2,509,100 | 5/1950 | Jordan | 254/134.3 FT |
| 3,079,673 | 3/1963 | Loehlein et al. | 29/611 |
| 3,222,497 | 12/1965 | Gordon, Jr. | 219/212 |
| 3,374,535 | 3/1968 | Tranel | 29/611 |
| 3,872,806 | 3/1975 | Bone | 29/241 |
| 4,074,421 | 2/1978 | Reutling et al. | 29/760 |
| 4,541,615 | 9/1985 | King, Jr. | 254/134.3 FT |

FOREIGN PATENT DOCUMENTS

| | | | |
|---|---|---|---|
| 2726408 | 12/1978 | Fed. Rep. of Germany | 219/528 |
| 530224 | 12/1940 | United Kingdom | 29/433 |

*Primary Examiner*—Howard N. Goldberg
*Assistant Examiner*—P. W. Echols
*Attorney, Agent, or Firm*—Neil M. Rose

[57] ABSTRACT

Method and apparatus for inserting the heating cable into the shell of an electric blanket, including a plurality of slotted tubes which are inserted to guide a flexible leader which draws the cable successively through each of the adjacent channels in the shell.

23 Claims, 23 Drawing Figures

BLANKET WIRE INSERTION MACHINE

BACKGROUND OF THE INVENTION

The present invention relates to apparatus for inserting the electric heating element wire into the fabric shell of an electric blanket. An electric blanket conventionally consists of two layers of fabric between which is sandwiched a heating element arranged in a tortuous fashion so as to cover essentially the entire area of the blanket. When the heating element is energized it delivers heat in a uniform manner to the entire surface of the blanket even though the heating element which is looped back and forth across the blanket is spaced from the adjacent legs by a number of inches. There are various types of electric blankets which utilize heating elements and temperature sensing means which differ in structure and functions from each other.

All electric blankets have some type of elongated heating element which heats by virtue of the electricity passing through one or more conductors. In addition, it is necessary that such blankets include some type of sensing means to determine when the blanket wire has become overheated and is likely to cause injury to the user or to start a fire. These temperature sensors or safety means may comprise a plurality of thermostats spaced throughout the length of the heating element or may comprise a continuous wire sensor to be associated with heating element wire or in closely spaced relationship with the heating element wire throughout the blanket. In any event, the necessity for the temperature sensing or temperature control means throughout the blanket has resulted in a structure which is somewhat difficult to insert between the spaced layers of the blanket fabric. The present invention has been applied to blanket heating wire which has its temperature sensing means integral with the wire and which has no spaced bimetallic thermostats to interfere with inserting the wire into the blanket.

Generally the layers of the blanket material are secured together along strips extending across or lengthwise of the blanket to provide a series of adjacent parallel channels or passageways through which the heating element wire may extend. There have been some attempts in the past to place the element wire between the layers of fabric before securing the fabric together but this approach has not proven very satisfactory. Alternatively, there have been many different approaches to manually inserting the wire back and forth through the adjacent channels of the blanket shell to complete the insertion of the element wire. In most cases these processes have been expensive, time consuming and very labor intensive. Accordingly, there is a recognized need for an automatic machine for inserting the blanket heating wire into the blanket shell with a minimum amount of labor.

SUMMARY OF THE INVENTION

The present invention involves a machine which is simple to operate and which rapidly inserts the blanket heating wire into the passageways formed in the blanket shell. The shell is initially loaded onto the machine by feeding the shell onto a series of guide tubes, one of which extends through each of the passageways or channels formed in the blanket shell. At the same time the blanket is assembled to these guide tubes, it is compressed slightly or folded so that it does not occupy its full length when positioned on the guide tubes of the machine. The guide tubes are then moved from a load position to an operating position where the heating wire is inserted into the blanket shell.

There is provided a flexible leader or threading means to which the heating element wire is then connected. This leader which comprises an elongated flexible coil spring is then threaded into a drive means positioned at each end of the guide tubes. The drive means at one end drives the flexible leader through the first guide tube into engagement with a second drive means positioned at the other end of the first guide tube. The second drive means picks up the leader and redirects it into the second guide tube and drives the leader upwardly through the second guide tube into engagement with another drive roller in the first drive means. This continues with the elongated flexible leader being driven successively through each of the guide tubes until the heating element wire has been drawn completely through the various adjacent parallel passageways in the blanket shell. After the leader has been driven through the last guide tube, the first drive means then transports the leader and the associated heating element wire attached to the leader back to the starting point. In transit, the leader engages a sensing means which then severs the element wire which has been automatically measured to the proper length.

To permit removal of the blanket with the then inserted heating element wire from the machine, the guide tubes are slotted in pairs with the slots of adjacent tubes facing each other. The lower drive rollers are positioned to be movable axially so as to disengage them from the lower ends of the loops of the heating element wire. When the upper ends of the guide tubes are moved out of engagement with the drive means carrying the conductor loops therewith, the blanket may then be slid upwardly off the guide tubes with the adjacent lengths of element wire moving through the slots in the tubes and automatically disengaging themselves from the guide tubes on the machine. When the operation has been completed, the heating element wire has been quickly and simply inserted into the channels or passageways in the blanket shell by means of the leader which has been forced through the guide tubes to insert the entire measured length of wire into the blanket.

The measuring of the wire length is accomplished by having the upper and lower drive means with the associated drive rollers spaced a predetermined distance apart so that each leg of the heating element wire will be of a suitable length to stretch across without folding in each of the parallel passageways of a blanket shell. The machine is provided with means for adjusting the number of transverse lengths of blanket wire as well as adjusting the lengths of each one of these legs. The drive means on the opposite ends of the guide tube are provided with adjustments so more or less of the guide tubes and rollers may be employed depending on whether a double bed, king size or queen size blanket might be being produced. Similarly, the spacing between the sets of drive rollers may vary to change the length of each of the legs of heating element wire extending through the guide tube. By making these various adjustments as to the number of rollers being used and the spacing between them, the machine can be set to sever the heating element wire automatically after the threading or insertion has been accomplished and the length predetermined obtained.

Accordingly, it is an object of the present invention to provide an improved machine for inserting a blanket heating wire into the fabric shell of the blanket.

It is a further object of the present invention to provide an improved blanket making machine for electric blankets which automatically draws the heating element wire through the tortuous passageway formed in the blanket shell.

Still another object of the present invention is to provide an automatic blanket wire insertion machine for an electric blanket which measures and cuts the proper length of wire for the particular blanket size being run on the machine.

Still another object of the present invention is to provide an improved electric blanket making machine which may be operated simply by merely inserting an blanket shell into the machine and connecting the heating element wire to a leader which will automatically thread the wire through the passageways formed in the blanket shell for the element wire.

A further object of the present invention is to provide an improved electric blanket fabrication machine having guide tubes which are insertable into the channels in a blanket wire shell with said guide tubes being slotted to permit disengagement of the guide tubes from the heating wire which is assembled to the blanket shell by means of the guide tubes.

It is another object of the present invention to provide an improved machine for threading a heating element into an electric blanket shell by means of a plurality of slotted guide tubes and automatic drive means which feed an elongated, flexible leader pulling the blanket wire through successive guide tubes to draw the heating wire through the channels in the blanket shell.

It is still another object of the present invention to provide an improved method of making an electric blanket wherein a blanket shell is assembled to a plurality of slotted guides and a flexible leader is employed to pull the heating element wire through the channels formed in the blanket shell.

Further objects and advantages of the present invention will become apparent as the following description proceeds and the features of novelty which characterize the invention will be pointed out in the claims annexed to and forming a part of the specification.

DESCRIPTION OF THE PREFERRED EMBODIMENT

Figure 1:
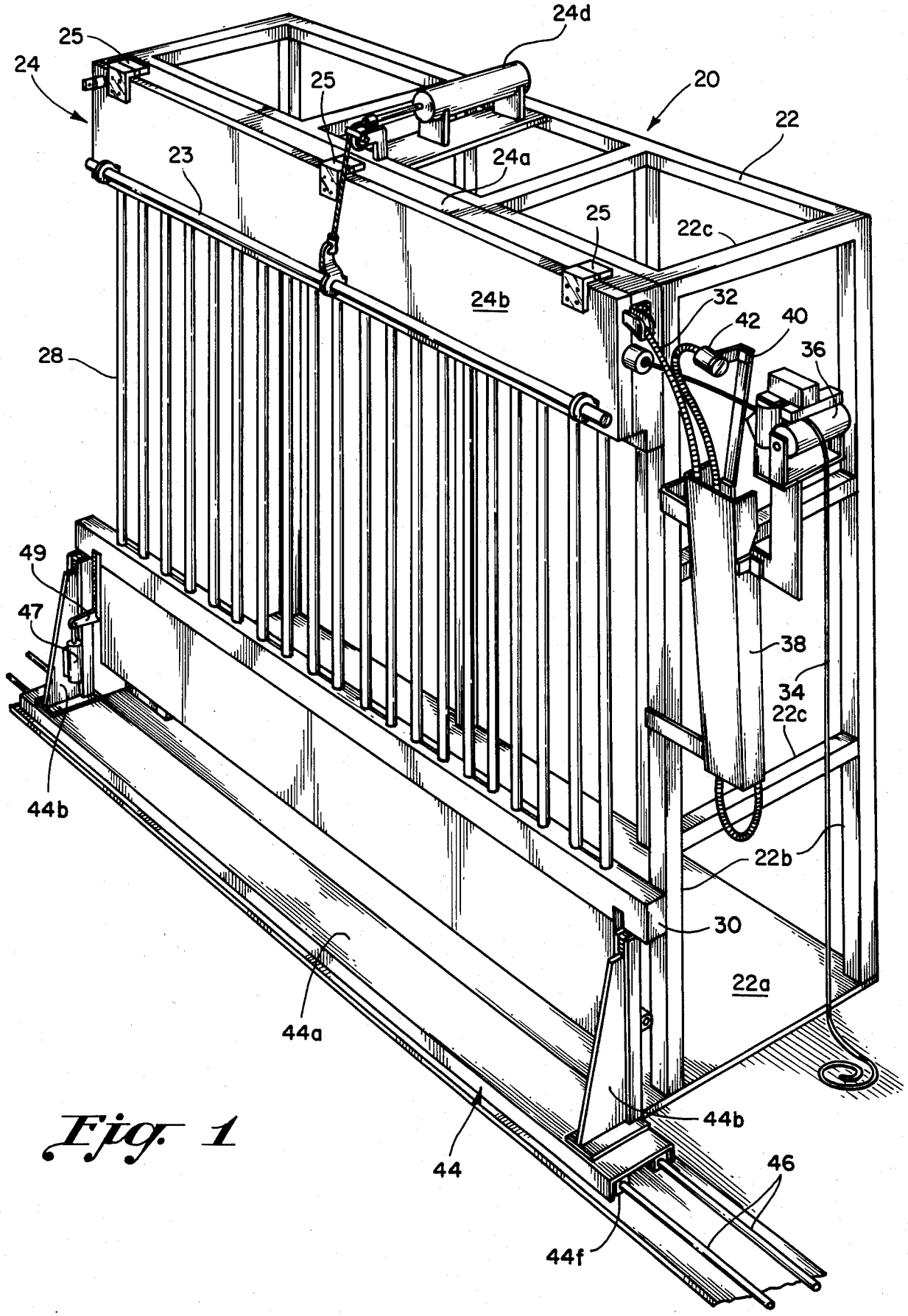
FIG. 1 is a perspective view of the blanket wire insertion machine of the present invention.
Figure 2:
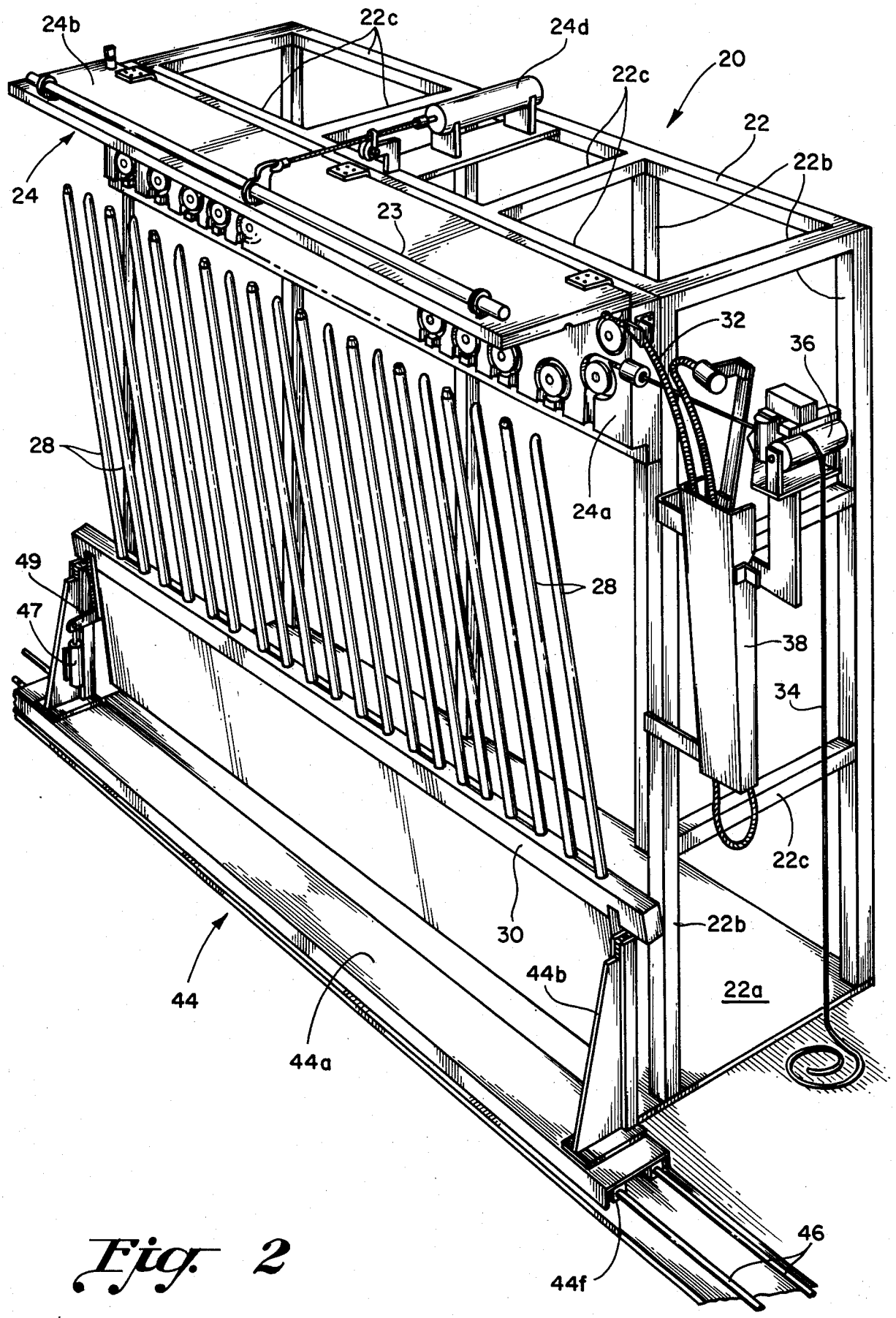
FIG. 2 is a perspective view of the machine of FIG. 1 showing the guide tubes and other portions of the machine in the unload position as compared to the operating position shown in FIG. 1.

Referring to FIGS. 1 and 2, there is shown a blanket wire insertion machine designated by reference numeral 20 which includes a box-like frame 22 having a base plate **22*a*, a plurality of vertically extending members 22*b* and a plurality of horizontally extending members 22*c* which combine to form the frame from which the various elements of the machine 20 are supported. At the upper front portion of the frame 22 there is provided the upper drive rollers and guide walls 24. Included in this assembly is a rear guide wall 24*a* and a pivotally supported closure wall 24*b*. Hinges 25 are provided to pivotally connect the upper edge of the closure wall 24*b* to the rear guide wall 24*a*. Hydraulic piston 24*d* shown in FIG. 2 is equipped with suitable controls so that the operator may pivot the wall 24*b* between the positions shown in FIGS. 1 and 2 which comprise the operating and the load/unload positions, respectively. A handle member 23 extending horizontally across the front of the wall 24*b* permits the machine operator to pivot the wall 24*b*** manually when necessary.

Figure 5:
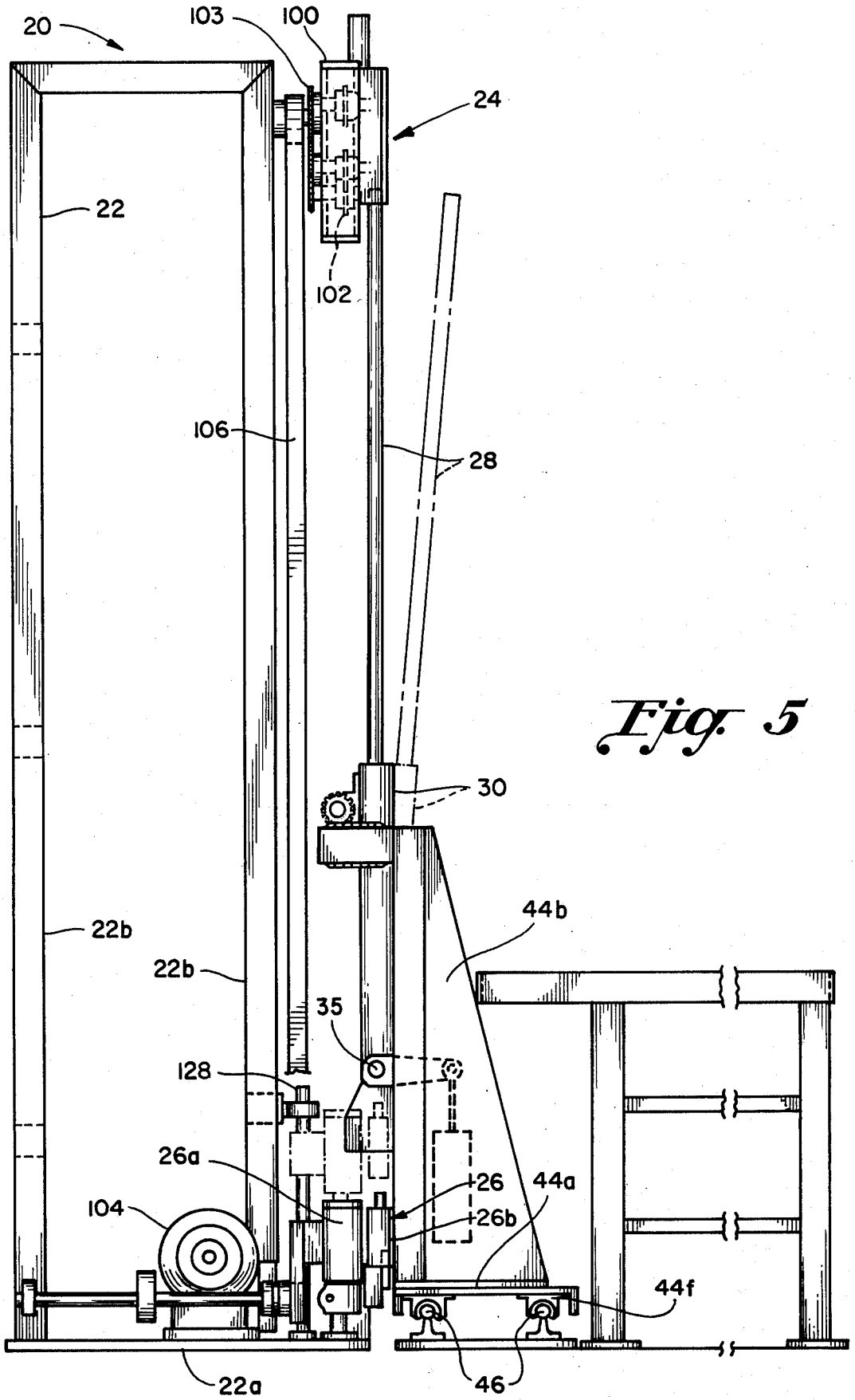
FIG. 5 is a side elevational view of the blanket wire machine showing the guide tubes in their operating position in solid lines and in dotted lines for the load/unload position.

Mounted on the front of the frame 22 adjacent the base **22*a* are the lower drive rollers and guide walls 26, as best shown in FIG. 5. The lower drive rollers and guide walls 26 include a transmission mechanism 26***a* and a roller section 26*b*.

Figure 6:
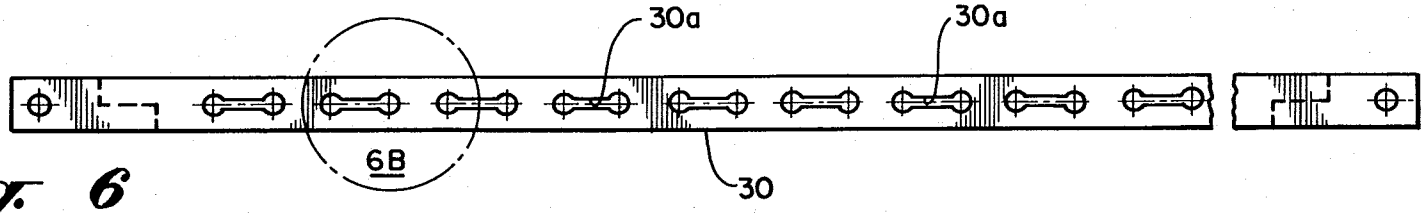
FIG. 6 is a top plan view of the guide tube support.
Figure 6A:
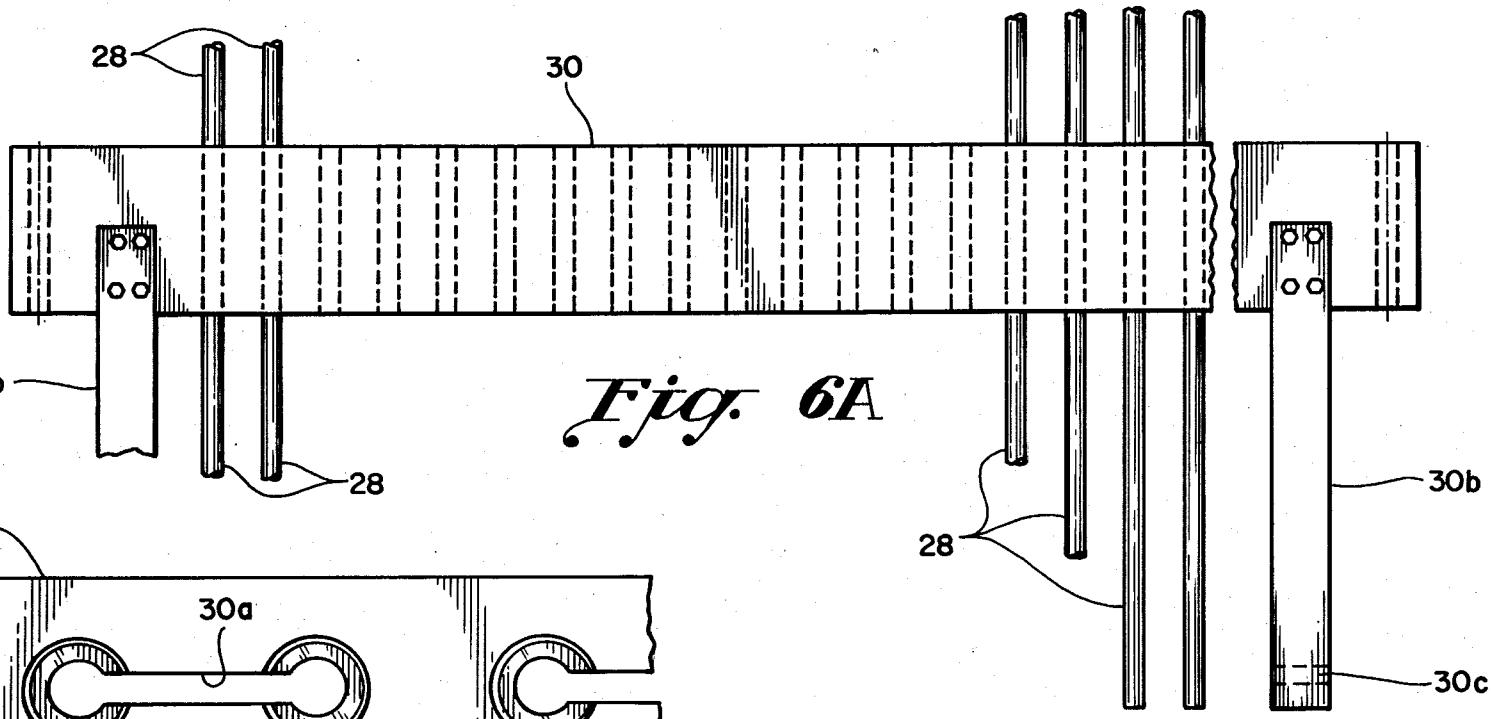
FIG. 6A is a front elevational view of the guide tube support with fragmentary showings of some of the guide tubes.
Figure 6B:
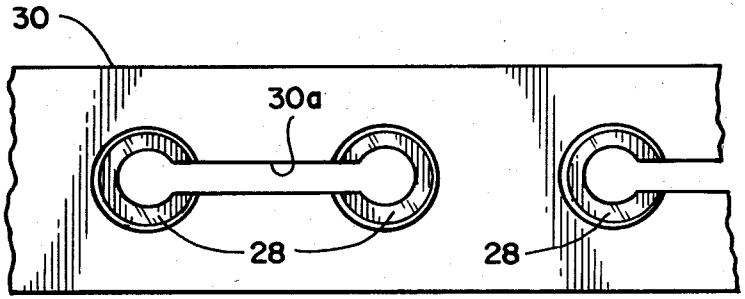
FIG. 6B is a greatly enlarged, fragmentary plan view of a portion of the guide tube support with three guide tubes in mounted position.

Mounted in front of the frame 22 are guide tubes 28 which are positioned between the upper and lower drive rollers and guide walls 24 and 26, respectively. The guide tubes 28 are positioned in a generally vertical position but are adapted to be tilted forwardly from the vertical position as shown in FIG. 1 to the somewhat inclined position shown in FIG. 2. The guide tubes 28 are mounted in a guide tube support 30. As is evident from FIGS. 6, 6A and 6B, the guide tube support 30 is formed with a plurality of openings 30*a* which have a dumbbell type shape when viewed in plan as in FIGS. 6 and 6B. Each of the enlarged ends of the holes 30*a* is adapted to receive one of the guide tubes 28 as shown in FIG. 6B. Secured adjacent to the opposite ends of the guide tube support 30 are support members 30*b* which mount the tube support for limited pivotal movement as will be more fully explained below.

Figure 3:
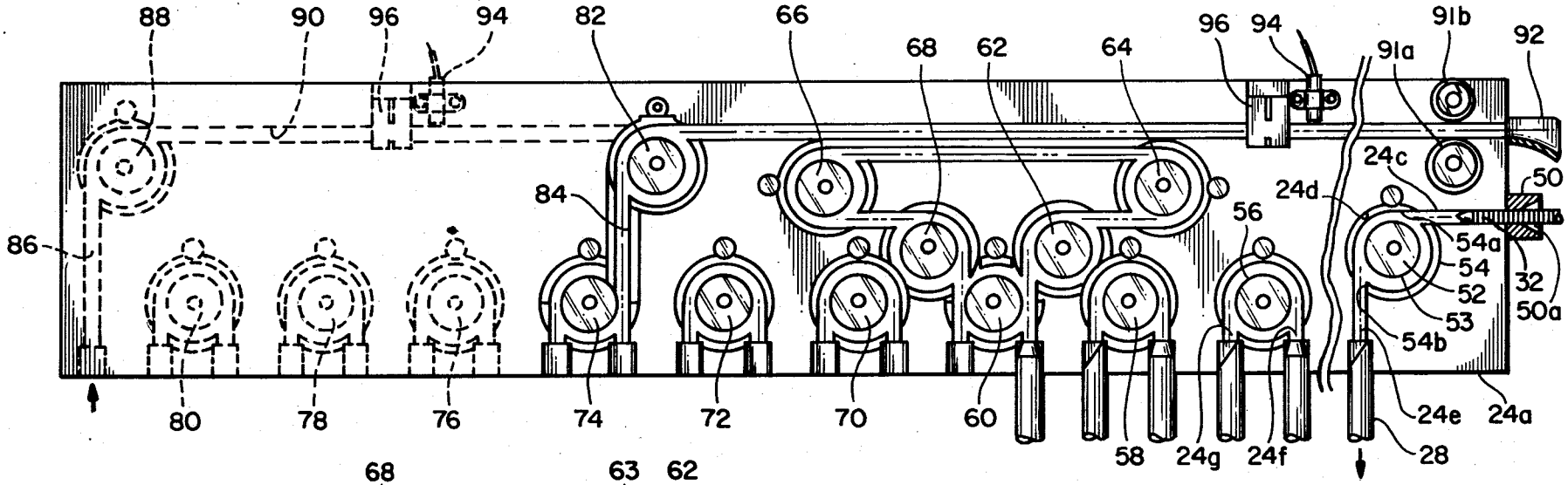
FIG. 3 is a front elevational view of the upper drive means which drives the flexible leader through the guide tubes to thread the heating element into a blanket shell.
Figure 3A:
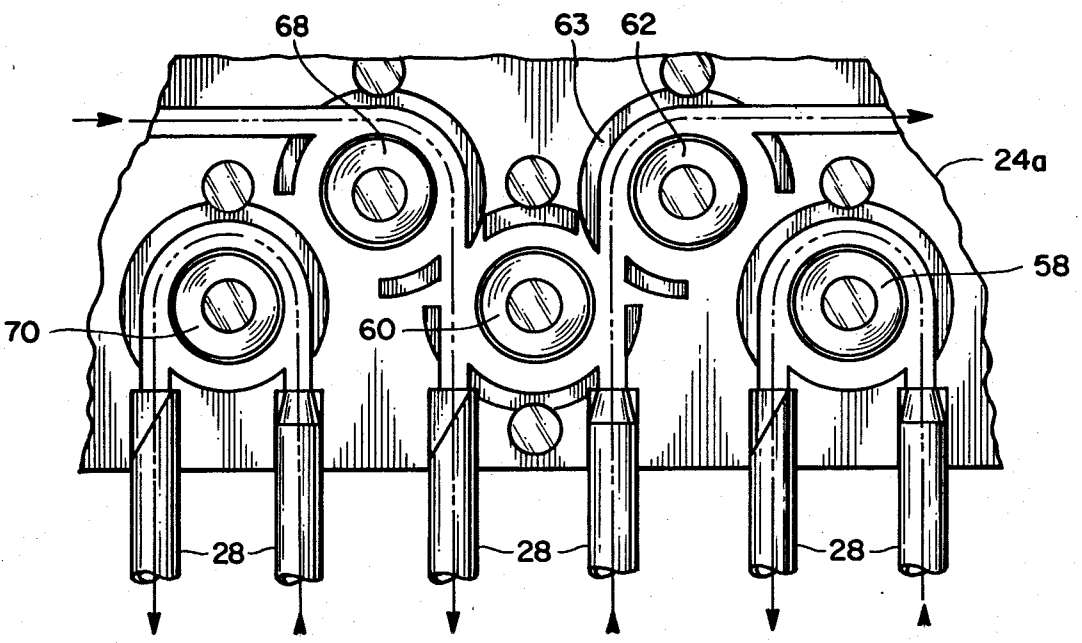
FIG. 3A is an enlarged fragmentary view of the drive means of FIG. 3 showing the manner in which it would be operated for threading the heating element into a dual control blanket.
Figure 7:
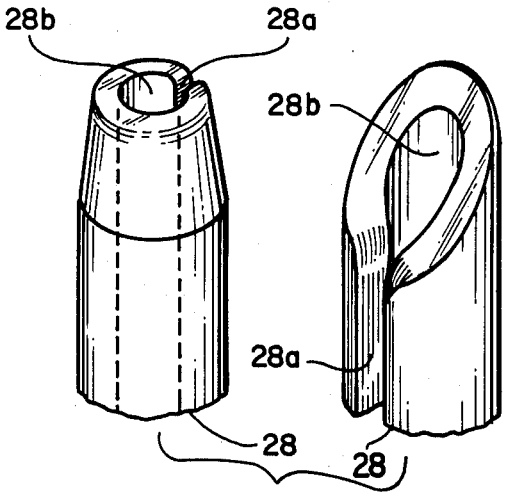
FIG. 7 is an enlarged, fragmentary view of the upper ends of two of the guide tubes in perspective.
Figure 7A:
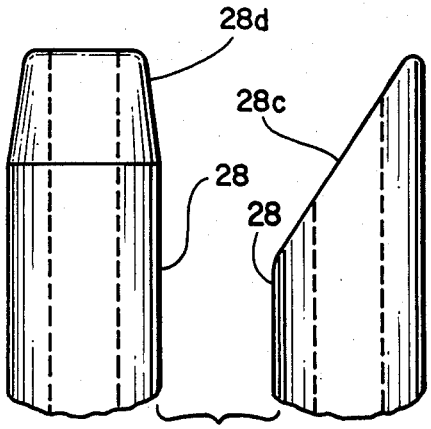
FIG. 7A is a front elevational view of the two guide tubes shown in FIG. 7.
Figure 7B:
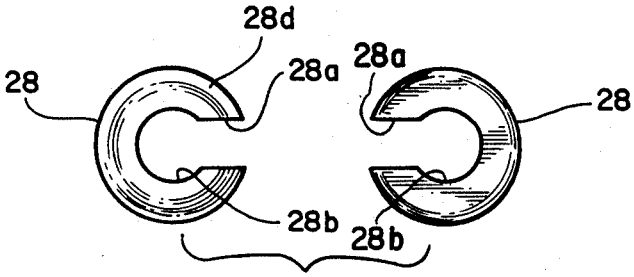
FIG. 7B is a top plan view of the two guide tubes shown in FIG. 7.

Referring to FIGS. 7A and 7B, the guide tubes 28 are elongated, each having a lengthwise extending slot 28*a*. The slots 28*a* extend radially through the side wall of each tube 28 to the interior bore 28*b* throughout the length of the tube. The guide tubes 28 are arranged in pairs with one tube having an angled end 28*c* while the other has a tapered or beveled end 28*d* giving it the shape of a truncated cone. The angled end tubes and beveled end tubes are arranged as shown in FIGS. 3 and 3A so that the slots 28*a* face away from the rollers in the upper drive means as will be described in greater detail below.

Figure 15:
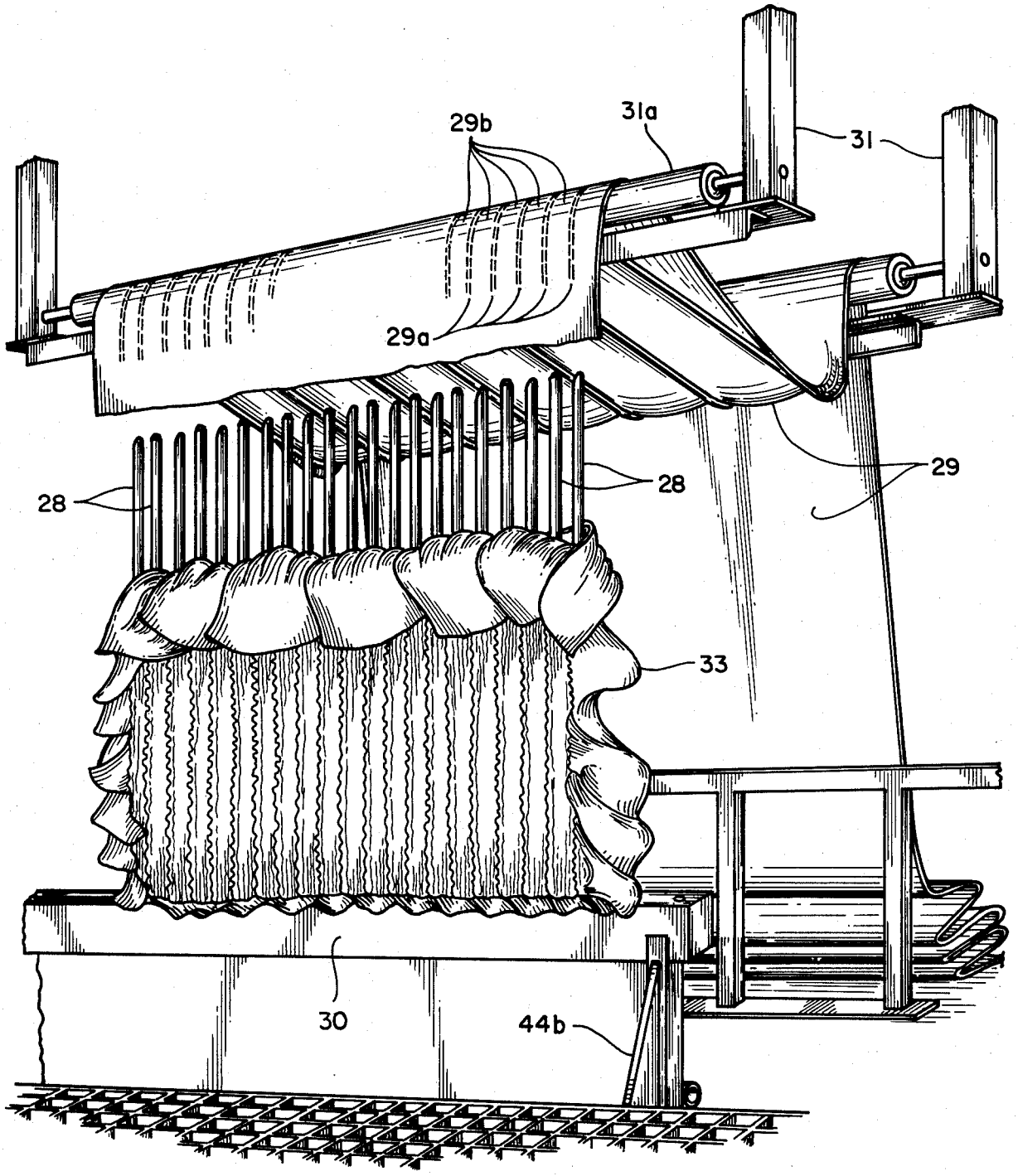
FIG. 15 is a perspective view of the carriage and guide tubes in the loading station where the blanket shell is assembled to the guide tubes.

The blanket wire insertion machine 20 is initially loaded with a blanket shell which has a plurality of parallel passageways extending between two layers of fabric. The blanket shell is loaded from above onto the guide tubes 28 so that the guide tubes 28 extend through each one of the adjacent passageways in the blanket shell. As shown in FIG. 15, there is provided a continuous supply of blanket shell 29 which is drawn over a frame 31 which includes a roller 31*a* so as to supply the blanket shell material from directly above the guide tubes 28. After threading enough of the shell material 29 onto the guide tubes 28 to provide a single blanket shell 33, the operator cuts the material 29 transversely at the top of guide tubes 28 along a premarked line and then rumples or compacts the shell 33 as shown in FIG. 15 so that it is shortened in the direction the tubes 28 extend. The blanket shell material 29 is preformed to have two spaced layers of fabric which are secured together along lengthwise ending lines 29*a* shown by the dotted lines in FIG. 15 to provide parallel coextensive channels 29*b* between the layers of material. These channels 29*b* are provided to receive the blanket heating wire 34.

Figure 14:
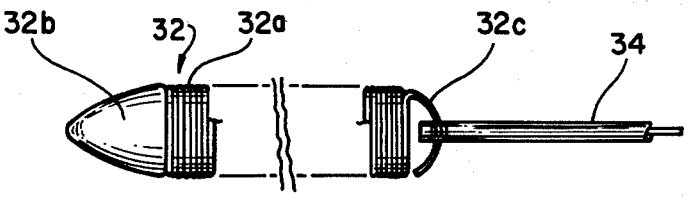
FIG. 14 is a side view of the flexible leader which draws the blanket wire through the guide tubes.
Figure 8:
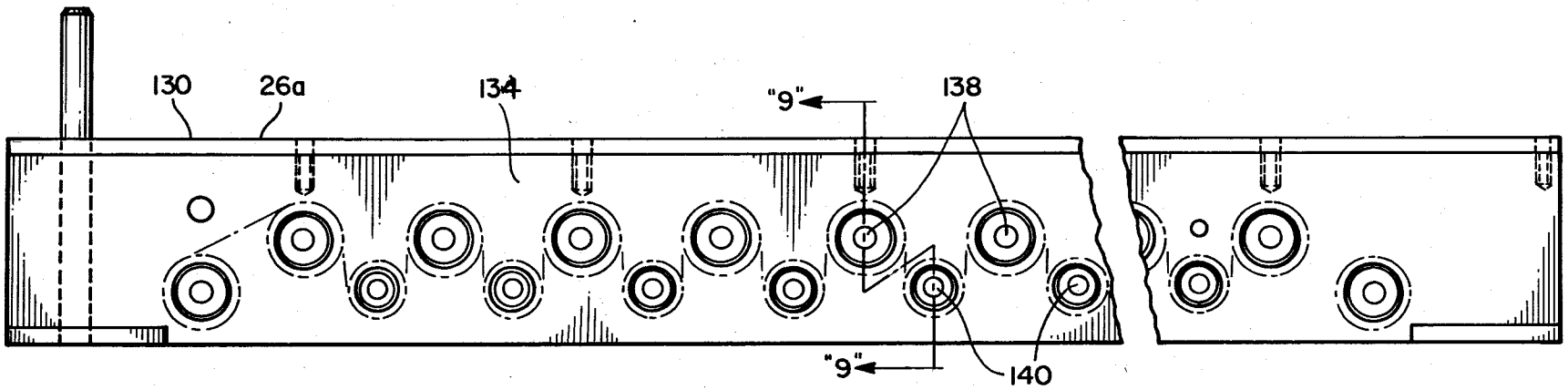
FIG. 8 is a front elevational view of the transmission for the lower drive means which propels the leader through the guide tubes.

The basic function of the machine 20 is to pull a single piece of blanket wire 34 through all of the parallel channels or passageways 29*b* in the blanket shell. This is accomplished by means of a leader or threading means 32 which is best shown in FIG. 14. The leader 32 may best be described as an elongated helical spring similar to the type of spring which might be used to retain a screen door in a closed position. It is on the order of half an inch in diameter and more than six feet long. As shown in FIG. 14, the spring portion is designated as 32*a* and it includes a clip portion 32*c* at one end which serves to connect the heating wire 34 to the leader 32. The other end of the leader 32 is provided with a conical tip 32*b* which facilitates the passage of the leader through the upper and lower drive means and the guide tubes 28.

Referring to FIGS. 1 and 2 it is noted that the heating wire 34 extends to the machine 20 up the right hand side of the machine as viewed in the perspective views. The vertically extending heating wire 34 is fed through a tensioning means 36 which is supported on the right end of the frame 22. The tensioning means 36 simply provides a controlled tension on the wire so that there will be no slack in the wire as it is drawn through the blanket shell, and if the tension exceeds a certain amount, the machine will automatically be shut off.

Figure 17:
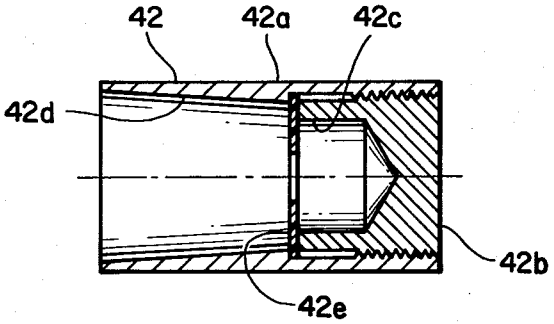
FIG. 17 is a sectional view of the leader retainer taken on line 17—17 of FIG. 16.
Figure 16:
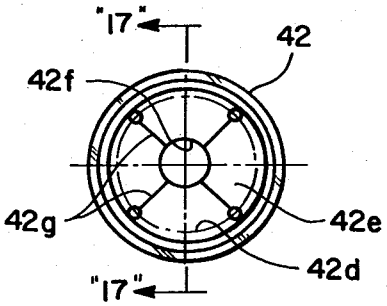
FIG. 16 is an enlarged view of the head on the leader retainer which receives the lead end of the leader at the end of each cycle of the machine.
Figure 9:
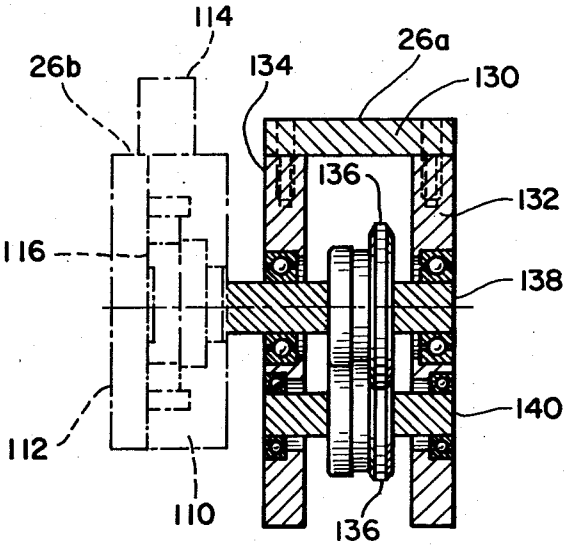
FIG. 9 is an enlarged, sectional view of the lower drive means transmission taken on line 9—9 of FIG. 8.
Figure 10:
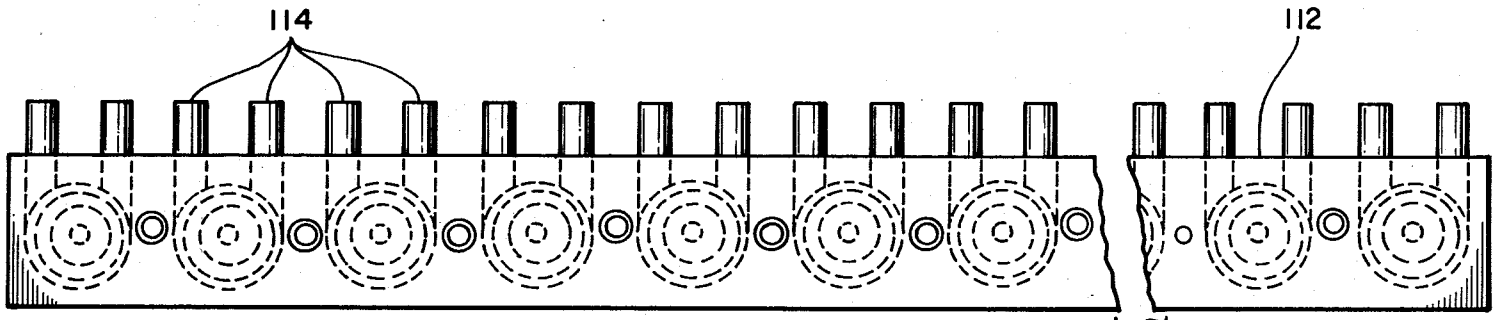
FIG. 10 is a front elevational view of the drive rollers of the lower drive means for propelling the leader through the drive tubes.

Also mounted on the right hand end of the frame 22 is a sheath 38 which serves as a temporary storage for the leader or threading means 32. Also associated with the sheath 38 is a swinging arm 40 which is mounted for pivotal movement about its lower end and which carries at its upper end a leader retainer 42 which serves to receive the leading end of the leader 32 when it exits the machine as will be more completely described below. The leader retainer 42 is shown in greater detail in FIGS. 16 and 17. It comprises a somewhat cylindrical member 42*a* having a threaded end receiving a plug 42*b* formed with a recess 42*c*. The retainer 42 is formed with a tapered opening 42*d* which terminates against an apertured rubber disc 42*e*. The disc 42*e* is formed with an aperture 42*f* from which slots 42*g* extend. The dimensions of the aperture 42*f* is such that when the lead end 32*b* of the leader 32 enters the recess 42*c*, the disc 42*e* will retain it within the retainer 42 until it is withdrawn by the operator.

The blanket wire insertion machine 20 is set up to have two blanket shell loading positions one to the left and one to the right of the frame 22 shown in FIGS. 1 and 2. The loading position shown in FIG. 15 is to the right of the frame 22 shown in FIGS. 1 and 2. The guide tubes 28 and the tube support 30 are all mounted on a movable carriage member 44. The carriage member 44 is mounted for transverse, horizontal movement on a pair of guide rails 46. The guide rails 46 extend laterally to the right and left of the frame 22 a sufficient distance so that the carriage member 44 may be moved in either direction completely beyond the frame 22 to positions designated as loading positions, one of which is shown in FIG. 15. In both of those loading positions, there is provided the frame 31 for delivering the blanket shell material 29 above the ends of the guide tubes 28 so that an operator may engage the guide tubes 28 into the transverse channels 29*b* formed in the blanket shell material 29. After a blanket shell material 29 has been placed over the guide tubes 28 and cut to the length to form the single shell 33, the carriage member 44 may be returned to the central position in front of the frame 22 as shown in FIGS. 1 and 2.

Figure 4:
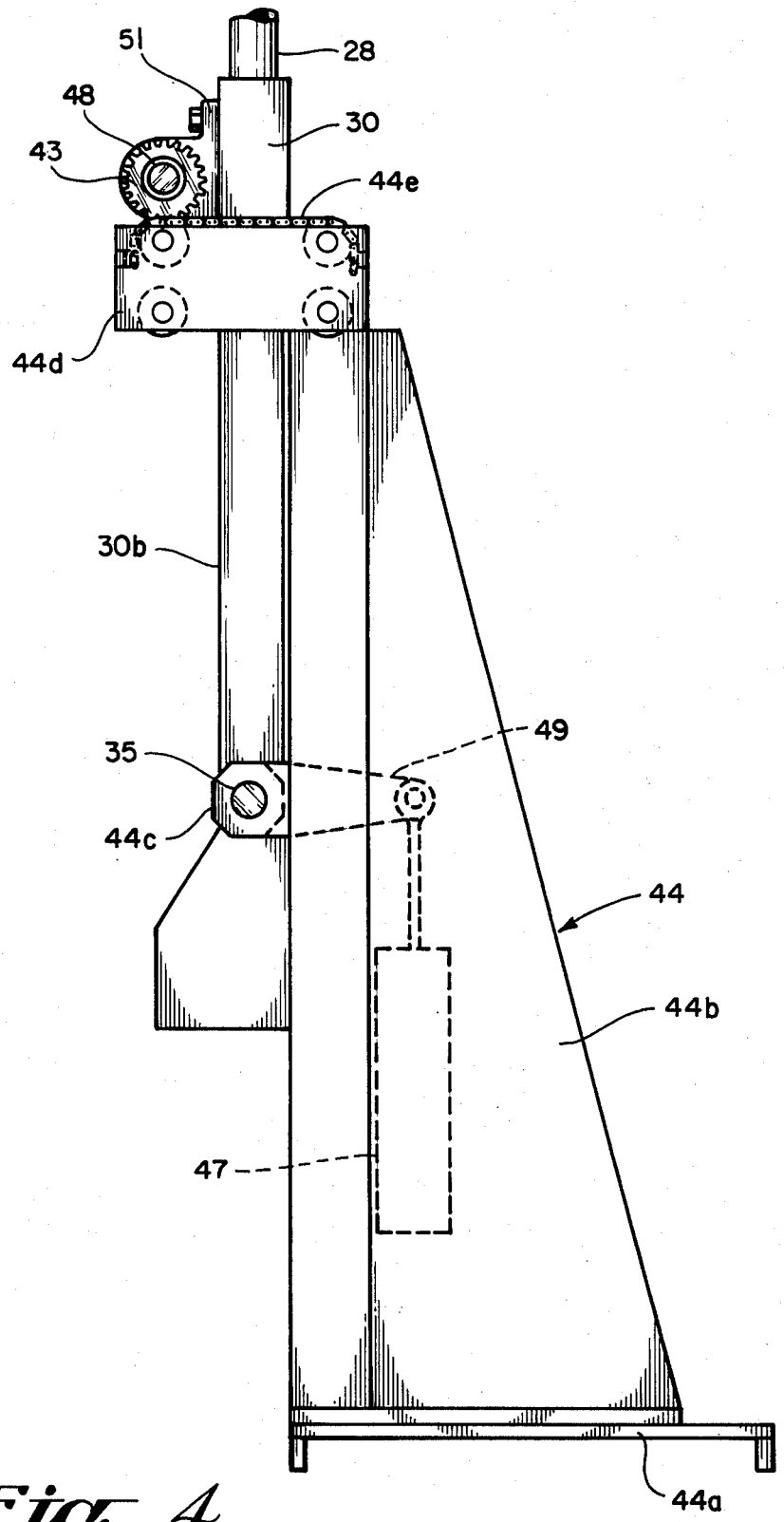
FIG. 4 is a side elevational view of the carriage which supports the guide tubes for limited pivotal movement.

The carriage member 44 consists of a base plate 44*a* which supports at either end vertical brackets 44*b*. As best shown in FIG. 4, the vertical brackets 44*b* are provided with means for mounting the guide tubes 28 and the support 30 for pivotal movement about a horizontal axis disposed intermediate the top and the bottom of the bracket 44*b*. A bearing block 44*c* projects rearwardly from the middle of each bracket 44*b*. The supports 30*b* for the guide tube support 30 extend downwardly and are provided with bearing openings 30*c* through which a transverse rod 35 extends. The rod 35 is journaled at its outer ends in the bearing blocks 44*c*.

Because of the elongated nature of the support 30 and the need for maintaining good alignment with respect to the guide tubes 28, there is provided a mechanism for restraining the tube support 30 from twisting as it is pivoted about the rod or axle 35. This means for increasing the rigidity of the tube support 30 includes plates 44*d* which extend from the top of each of the brackets 44*b* to support a section of roller chain 44*e* at each end of the support 30 as shown in FIG. 4. Each chain 44*e* is rigidly connected to the bracket 44*b* and is engaged by a sprocket 43 mounted on each end of a shaft 48 supported by pillow blocks 51 mounted at both ends of the support 30. The shaft 48 is sufficiently heavy to resist twisting and, therefore, causes the two sprockets 43 to move across the roller chain 44*e* in synchronism so that both ends of the tube support 30 are displaced equally. A suitable hydraulic piston 47 operating on a crank arm 49 is provided to rotate the tube support 30 about the axle 35 at an angle equal to three or four degrees. This angular displacement disengages the upper ends of the guide tubes 28 from the rear guide wall 24*a* and permits the blanket shell to be removed from the guide tubes 28 when the process of inserting the blanket wire into the blanket shell has been completed.

The carriage member 44 is provided with a number of bearing members 44*f* which engage the rails 46 and permit the carriage 44 to be moved from the operating position in front of the frame 22 as shown in FIGS. 1 and 2 to a displaced position to the left or right of the frame 22 (as shown in FIG. 15, for example) where the carriage 44 may have a blanket shell 33 mounted on its respective guide tubes 28. There are two carriages 44 with associated guide tubes provided for the machine so that when one of the carriages is in the position shown in FIGS. 1 and 2, there is a second carriage positioned to the right or left where the operator may be loading the blanket shell 33 onto the guide tubes 28.

As indicated above, the upper drive rollers and guide walls 24 include a rear guide wall 24*a* which is best shown in FIGS. 3 and 3A. The leader 32 is adapted to be inserted into the right end of the guide wall 24*a* as shown in FIG. 3. Enlarged bushing 50 is mounted at the end of the wall 24*a* and is formed with a tapered opening 50*a* which receives the end of the leader 32 and directs it into a horizontally extending slot 24*c* formed in the wall 24*a* and being of the proper width and depth to receive the leader 32. At the end of the horizontally extending slot 24*c*, there is a shallow, cylindrical recess 24*d* which has mounted in the center coaxial therewith a rotating roller 52. Positioned within the recess 24*d* are hardened steel guide walls 54 which have appropriate openings 54*a* and 54*b* which interconnect with the channel 24*c* and an outlet channel 24*e*. The roller 52 has a rubber exterior surface 53 which is intended to engage and drive the leader 32 when it is inserted through the bushing 50 and the channel 24*c*. The channel 24*c* and the channel 24*e* extend substantially tangential to the roller 52 so that the leader 32 is gripped between the roller 52 and the harden steel insert 54 so that it is driven through an angle of 90° and discharged downwardly into the first of the guide tubes 28. The rubber surface 53 of the drive rollers assures good driving engagement with the leader 32 which is gripped between the roller and the hardened steel guide walls 54.

Adjacent to the roller 52 with its associated channels and guide walls is a second roller 56 which is similar in structure and function to the roller 52, the only difference being that the guide walls are arranged so that the leader 32 enters through a channel 24*f* and exits through a channel 24*g* after engaging the roller 56 through 180° of its periphery. The succeeding roller 58 performs the identical function in receiving the leader 32 as it passes upwardly through a guide tube 28 and reverses its direction, driving it downwardly to the next guide tube 28.

Further to the left as viewed in FIG. 3, there is a series of rollers 60, 62, 64, 66 and 68 which serve to drive the leader in a loop around these various rollers. The purpose of the looping of the heating wire 34 around the rollers 62, 64, 66 and 68 is simply to provide an intermediate loop of heating wire which permits connection to a control means so that the blanket may be provided with dual controls for the two sections to the right and the left of the roller 60, as seen in FIG. 3. The manner in which the hardened guide walls 54 are arranged to accomplish the directing of the leader 32 around the rollers 62, 64 and 68 is shown in FIG. 3A with the dash line indicating the route of the leader 32. In FIG. 3, however, the hardened guide walls 54 are arranged to eliminate the control loop around the rollers 64 and 66 as would be the pattern for a single control double bed blanket. Comparing the guide walls associated with roller 60, it may be noted that in FIG. 3, there is a U-shaped guide wall 61 that directs the leader 32 completely around roller 60. In contrast, guide wall 61 is removed in FIG. 3A allowing the leader 32 to move upwardly past roller 60 where it engages a 90° guide wall 63 which directs the leader 32 around the roller 62. From the foregoing, it may be seen that by the changes made in the insertable hardened guide walls 54, of which 61 and 63 are specific examples, the pattern followed by the leader 32 and the blanket wire 34 may be varied to suit the type of blanket being run on the machine.

There are additional rollers 70, 72, 74, 76, 78 and 80 which all perform the same function by merely reversing the direction of the upwardly driven leader 32 and driving it downwardly through the adjacent guide tube 28. Intermediate the rollers 72 and 74 there is a roller 82 which is connected to the recess for roller 74 by a passageway 84. The purpose of this passageway 84 is to receive the leader 32 at the end of the wire insertion procedure for a particular size blanket. In such a situation, the rollers 76, 78, and 80 perform no function.

At the left end of the rear guide wall 24*a* there is provided a vertically extending passageway 86 which extends tangent to a roller 88 from which the horizontally extending exit passageway 90 extends. Thus the leader 32, after passing through all of the passageways in the blanket shell, is driven upwardly into the horizontal passageway 90 where it moves toward the right and is discharged over a guide means 92 into engagement with the retainer 42 which arrests and holds the end of the leader 32. A last set of rollers including a driven roller 91*a* and an idler roller 91*b* engage the leader 32 just before it exits the passageway 90 and drive the leader 32 until only the trailing end remains in passageway 90 as the machine cycle is completed.

Spring means (not shown) bias the pivoted arm 40 counterclockwise, as viewed in FIGS. 1 and 2, to position the reainer 42 adjacent the guide means 92 with the internal bore 42*d* aligned with the passageway 90. The discharging leader 32 deflects the arm 40 to the position shown in FIGS. 1 and 2 allowing the leader 32 to rest in a looped position within the guard 38. In this position, as shown in FIGS. 1 and 2, the operator has the leader 32 easily accessible to begin the cycle moving the lead end of leader 32 from the bushing 42 to the bushing 50.

In the channel or passageway 90 extending horizontally across the rear guide wall 24*a* there is an magnetic sensing means 94 which is triggered by the passage of the leader 32 to actuate a wire cutoff 96 also positioned in the channel 90. This provides an automatic severing of the heating wire 34 at an appropriate length as determined by the length of the guide tubes and the spacing of the upper and lower drive rollers as will be explained in greater detail below.

As was explained initially, the front closure wall 24*b* is hingedly connected to the rear wall 24*a* by means of hinges 25. In the operating condition of the machine, the wall 24*b* is in the position shown in FIG. 1 so as to close the various channels and recesses through which the leader 32 passes in its movement in engagement with the upper drive rollers. In that position, the upper ends of the guide tubes 28 are clamped within recesses 24*b* as best shown in FIGS. 3 and 3A. Once the heating wire 34 has been inserted into the blanket shell, the closure wall 24*b* is raised to the horizontal position shown in FIG. 2 and the guide tubes 28 are pivoted forwardly to the position shown in FIG. 2. This movement automatically disengages the upper loops of the heating wire 34 from the upper drive rollers, thereby permitting the blanket shell with the assembled heating wire to be moved upwardly from the guide tubes 28.

Figure 13:
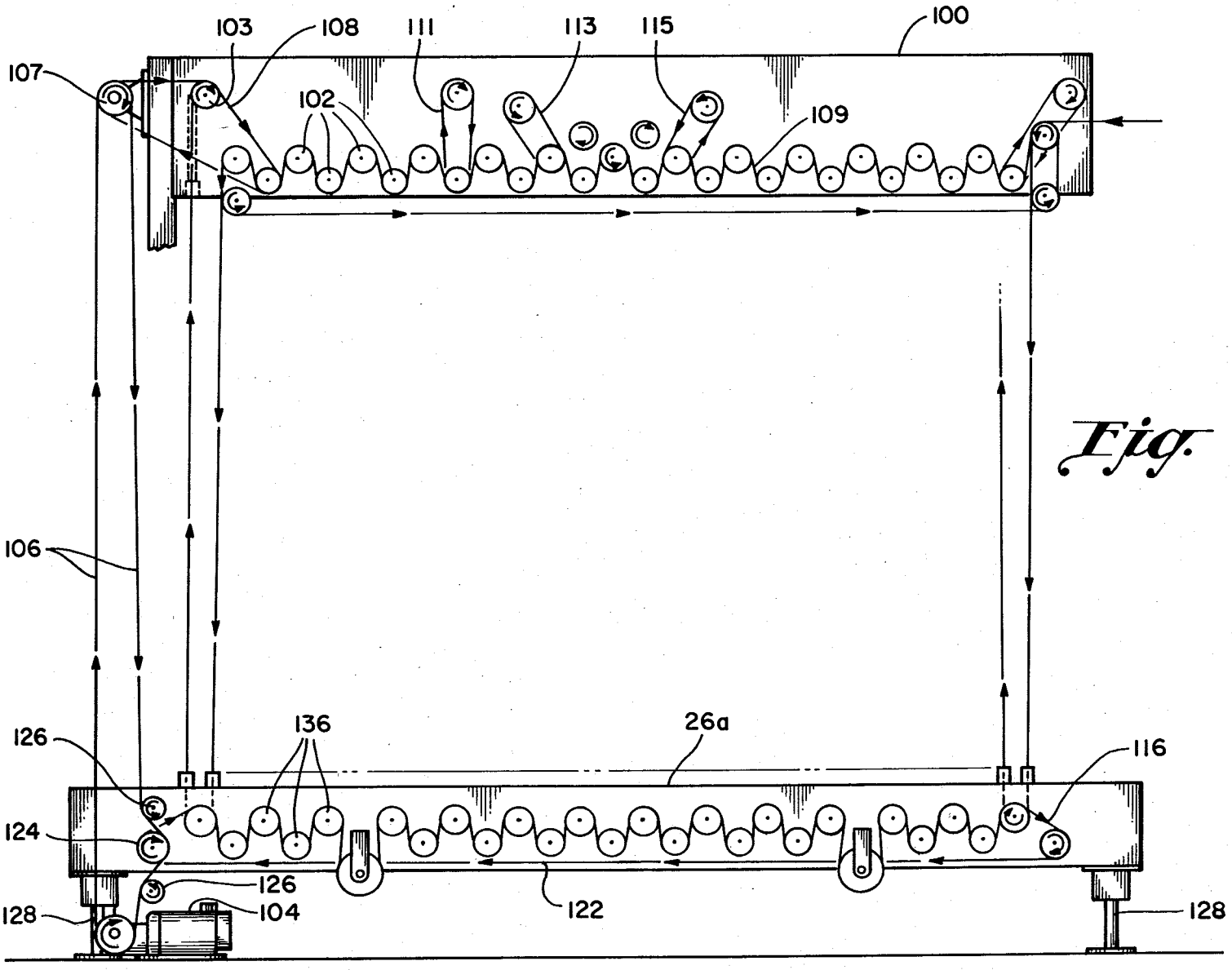
FIG. 13 is a diagramatic showing of the drive belts and chains which interconnect the upper and lower drive means with a common drive motor.

For the purpose of driving the rollers described above in connection with the upper drive roller and guide wall 24, there is provided an upper transmission 100 which may be seen in an end elevation view in FIG. 5 and is shown schematically in FIG. 13. It consists of a series of shafts carrying the drive rollers 52, 56, 58, 60, 62, 64, 66, 68, 70, 72, 74, 76, 78, 80, 88 and 82 on their forward ends and having a series of drive sprockets 102 mounted within a transmission housing 100*a* and drive sprockets 103 on the rearwardly extending ends of some of the shafts. A series of roller chains are provided on the upper transmission 100 to drive the various rollers as shown in FIG. 13. A gear motor 104 mounted on the base plate 22*a* of frame 22 drives a toothed belt 106 which drives both the upper transmission 100 and the lower transmission 26*a*. As can be seen in FIG. 13, a takeoff chain 108 is driven by an upper dual sprocket 107 which is in turn driven by the belt 106. The chain 108 drives one of the series of sprockets 103 mounted on the shafts which extend rearwardly of the transmission housing 100*a*. The chain 108 drives a chain 109 which engages the sprockets 102 and drives all of the rollers 56, 58, 60, 70, 72, 74, 76, 78 and 80. The roller 88 is driven by chain 108 and the rollers 82, 66 and 64 are driven by chains 111, 113 and 115, respectively.

The lower drive rollers and guide walls 26, as indicated above, include the transmission 26*a* and a guide wall section 26*b*, as best shown in FIGS. 8 through 12. The section 26*b* includes a rear wall 110 and a front wall 112. Secured to the rear wall 110 are a number of abbreviated guide tubes 114 which are aligned with corresponding guide tubes 28 and are of similar size and have slots 114*a* which are aligned with the slots formed in the guide tubes 28. Each of the pairs of abbreviated guide tubes 114 are formed with bores 114*b* which extend tangentially with respect to a roller 116 and have hardened guide walls 118 received in recesses 120 in similar manner to the rollers and guide walls in the upper drive section. The rollers 116 are rubber covered and positioned with respect to the guide walls 118 so that the leader 32 is received from one of the guide tubes 114, extends around 180° of the roller 116 and is driven upwardly through the adjacent guide tube 114.

One difference between the rollers 116 and their counterparts in the upper drive section is the fact that the lower guide rollers 116 are mounted for axial movement with respect to the guide tubes 114 and the associated guide walls 118. Thus, at the end of the wire insertion process, each of the guide rollers is moved rearwardly into a recess 117 which is slightly larger in diameter than the guide roller, thereby disengaging the lower loop of heating wire 34 from the drive roller 116. This disengagement is accomplished by moving the roller and guide wall section 26*b* away from the transmission 26*a* to the dotted line position shown in FIG. 9. Prior to this movement and during the threading of the blanket wire 34 through the blanket shell, the transmission 26*a* and the guide wall section 26*b* are in abutting relationship.

The drive rollers in the lower transmission 26*a* are driven by means of a continuous roller chain 122, as shown schematically in FIG. 13. The roller chain 122 is driven by means of a roller 124 which is mounted between a pair of sprockets 126 which are arranged on either side of the belt 106 in order to maintain tension on the belt 106. The purpose of this drive arrangement involving the rollers 124 and 126 is to permit the lower transmission 26*a* and the associated roller and guide section 26*b* to be moved vertically on its mounting columns 128 as shown in FIGS. 13 and 5. Suitable hydraulic pistons are provided to move the lower drive rollers and guide walls 26 between the position shown in solid and dotted lines in FIG. 5. This permits the operator to vary the spacing of the upper and lower drive rollers so as to accommodate blankets of varying length. By setting the spacing between the drive rollers to the precise position desired for a particular type of blanket, it is possible to use this spacing of the drive rollers as a means of measuring accurately the length of heating wire which is inserted into the blanket shell. As a consequence, the machine is capable of providing the exact amount of wire without any measurement being made by the operator.

The transmission 26*a* includes a top wall 130, a rear wall 132 and a front wall 134 which together form a box-like housing open at the bottom within which a series of sprockets 136 are supported for driving engagement with the above described chain 122. The sprockets 136 are carried by upper shafts 138 and lower shafts 140, all of which are journaled in bearings mounted in the rear wall 132 and the front wall 134. The shafts 138 extend through the front wall 134 and mount on their outer ends the rollers 116. Suitable hydraulic means are provided to move the roller and guide section 26*b* with respect to the transmission 26*a* between the positions in which the section 26*b* abuts the transmission 26*a* to the position shown in dotted lines in FIG. 9 where the section 26*b* is spaced approximately one inch away from the transmission 26*a*.

Figure 11A:
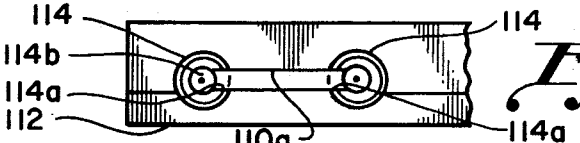
FIG. 11A is a top plan view of the portion of the drive means shown in FIG. 11 but with the cover plate assembled thereto.
Figure 12:
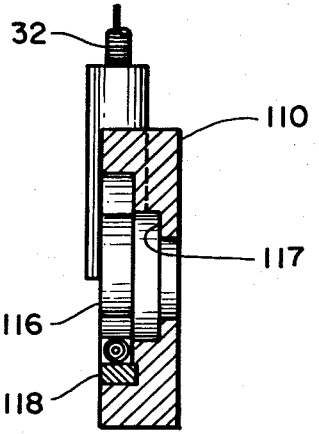
FIG. 12 is a sectional view taken on line 12—12 of FIG. 11.
Figure 11:
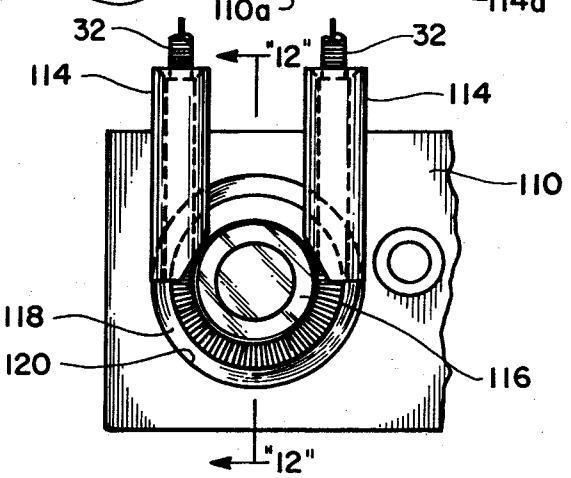
FIG. 11 is an enlarged, fragmentary elevational view of a portion of the drive means shown in FIG. 10, with its front cover plate removed.

To better appreciate the manner in which the lower loops of blanket wire are disengaged from the roller and guide section 26 reference should be made again to FIGS. 11 and 11A. The leader 32 is driven around the roller 16 thereby extending the blanket wire 34 down through each of the abbreviated guide tubes 114 around the roller 116 and back up the other abbreviated guide tube 114. When the roller 116 moves rearwardly with respect to the section 26*b* into the recess 117 the loop of blanket wire is left loosely disposed within the recess formed by the guide walls 118. The guide tubes 114 are provided with slots 114*a* and the rear wall 110 is formed with a slot or recess 110*a* which permits the loop in the blanket wire to be withdrawn upwardly out of the section 26*b*. It also follows that the aligned guide tubes 28 are also slotted, thereby permitting the lower loops in the blanket wire to be withdrawn upwardly so that the blanket shell may be completely disengaged from the guide tubes 28.

To summarize the operation of the blanket wire insertion machine 20, a brief description will be given of the manner in which the machine operates. Referring first to FIG. 15, one of the carriages 44 is positioned in the load/unload position where a blanket shell may be inserted onto the guide tubes 28 from the supply of laminated material 29 having the passageways 29*b* formed therein. After the material is threaded downwardly onto the guide tubes 28, the material is cut off to the marked length of a single blanket shell 33. The carriage then is moved to the left to the position shown in FIGS. 1 and 2 of the drawings. The hydraulic piston 47 is actuated causing the guide tubes to pivot from the position shown in FIG. 2 to that shown in FIG. 1 while at the same time the wall 24*b* pivots to the vertical position in which the top ends of the guide tubes 28 are positioned adjacent the rollers in the upper drive roller and guide walls 24. The operator then removes the lead end of the leader 32 from the retainer 42 and inserts it into the bushing 50 after having attached the heating wire 34 to the trailing end of the leader 32. The machine is then activated to cause the drive rollers to drive the leader 32 between the upper and lower rollers until it has threaded through all of the guide tubes 28 and the associated abbreviated guide tubes 114. At that time, the leader 32 is driven down the horizontal discharge passageway 90 actuating the cutoff and terminating the cycle. The operator then actuates the machine to raise the wall 24*b* and pivot the guide tubes 28 to the position shown in FIG. 2 at which time the blanket shell with its associated heating wire may be removed upwardly from the guide tubes 28. At the same time, the wall 24*b* moves to the raised position, the roller section 26*b* and the transmission 26*a* of the lower drive rollers in guide walls 26 move apart to the position shown in FIG. 9 withdrawing the rollers 116 into the recesses 117 and permitting the lower loops of heating wire 34 to be withdrawn upwardly with the blanket shell 33. These lower loops pass through the slots 114*a* in the abbreviated guide walls 114 and through the slots 28*a* formed in the guide tubes 28.

The use of the elongated flexible leader 32 in combination with the drive rollers and slotted guide tubes provides a simple and effective means for threading the elongated heating wire into the tortuous passageways in the blanket shell. This approach reduces the amount of labor and the costs involved in assembling the blanket wire to the blanket shell.

What is claimed as new and desired to be secured by Letters Patent of the United States is:

1. An apparatus for inserting a heating element into a fabric shell of an electric blanket, the shell including two spaced fabric layers which are secured together to form open-ended parallel passageways across the entire shell, comprising a plurality of elongated tubes supported at one end in a common plane and spaced for insertion into said passageways in said shell, said tubes being formed with slots which extend throughout the length of each tube, said slots in adjacent pairs of tubes being in spaced facing relationship, a leader having a leading end and a trailing end and having means to secure its trailing end to a length of a heating wire, drive means positioned at both ends of said tubes to tubes, said drive means engaging said leader and driving said leader through each of said tubes successively to draw said length of heating wire through the passageways of said shell whereby said heating wire extends continuously through said passageway.

2. The apparatus of claim 1 wherein said drive means includes a plurality of rollers and adjacent guide walls which drive said leader down each of said tubes and as said leader exits each tube redirects said leader into the adjacent tube, said rollers being displaceable relative to said tubes to disengage said rollers from the heating wire after said heating wire has been inserted into said passageways in said shell.

3. The apparatus of claim 2 wherein said tubes are secured to a support which is mounted for pivotal movement about an axis transverse to the axis of said tubes, said tubes being movable between a load position where the unsupported ends of said tubes are spaced from said drive means and said tubes may be inserted into the passageways in said blanket shell and an operating position in which said unsupported ends of said tubes are in engagement with said drive means.

4. The apparatus of claim 3 wherein said support comprises an elongated bar extending perpendicular to said tubes and receiving the ends of said tubes therein and having slots formed therein which extend between and connect with the slots formed in said tubes.

5. The combination of claim 3 wherein said drive means includes a first set of rollers and guide walls adjacent the unsupported ends of said tubes and a second set of rollers and guide walls adjacent the supported ends of said tubes, said first guide walls being formed by open channels in a fixedly mounted plate and by a wall member which is movable between a first position spaced from said plate and a second position in which said wall engages said plate closing said open channels, said tubes in said operating position being engaged in said channels with the unsupported ends of said tubes being positioned between said plate and said wall.

6. The combination of claim 2 wherein said leader comprises an elongated coil spring which is smaller in diameter than the interior diameter of said tubes, said spring being substantially equal in length to the length of each of said tubes so that one of the drive means at either end of said tubes will be continuously driving said leader until the heating wire is completely pulled through said passageways in said shell.

7. The combination of claim 1 wherein said tubes are formed at their unsupported ends with ends which are beveled around the periphery of each tube to facilitate insertion of said tubes into the passageways in said shell, said unsupported ends also being angled toward said slots to facilitate said tubes passing through said passageways, said slots being sufficiently wide to permit said heating wire to pass through when disengaging said drive means and said tubes from said shell and said heating wire.

8. The combination of claim 3 wherein said tubes are positioned generally vertically when in said operating position and have their unsupported ends displaced away from said drive means in said load position, support means above said tubes and said drive means to support and position a blanket shell above said tubes for delivery downwardly onto said tubes.

9. The combination of claim 5 wherein said second set of rollers and guide walls comprises a set of axially displaceable rollers received in a guide block formed with guide walls spaced radially outwardly from said rollers, said rollers being mounted for axial displacement away from said guide walls to permit said heating wire to be disengaged from said second set of rollers.

10. The combination of claim 9 wherein said guide block is provided with guide stubs which are short slotted tubes mounted to guide said leader between said tubes and said second set of rollers, said stubs each having an internal bore and a slot corresponding in diameter and width to the bore and slot in said tubes.

11. Apparatus for inserting a heating wire into an electric blanket shell of the type having two layers of fabric secured together to form a plurality of open ended passageways within which a heating wire is to be disposed comprising a frame for supporting a blanket shell and drive means for inserting said wire into said shell, a leader for pulling said heating wire through said passageways in said shell, means for attaching a length of heating wire to said leader, a plurality of parallel tubes mounted for insertion into said open ended passageways in said shell, a set of drive means at each end of said tubes, said drive means being positioned to force said leader through each one of said tubes in successive order to draw said heating wire into said tubes and the passageways in said shell, said drive means and said tubes being displaceable relative to each other so that said drive means may be disengaged from said heating wire after it has been inserted into said passageways in said shell.

12. The combination of claim 11 wherein said leader comprises an elongated coil spring which is longer than the distance between said drive means so that said leader is in continuous engagement with either one of said drive means while said heating wire is being inserted into said shell, said leader having means at one end for securing one end of a piece of heating wire thereto, said leader having a conical nose portion at the other end of said coil spring to facilitate entry into and passage through said tubes which are provided with lengthwise extending slots of sufficient width to permit said heating wire to be displaced laterally of said tubes and disengaged therefrom, said leader being substantially larger in diameter than the width of said slots.

13. The combination of claim 12 wherein said drive means includes means for sensing the passage of said leader through all of said passageways in said shell and completion of the heating wire insertion, wire cutoff means positioned in said drive means adjacent the point where said leader enters said drive means, said sensing means actuating said cutoff means to cut said heating wire to the proper length after said heating wire insertion has been completed.

14. The combination of claim 11 wherein said drive means comprises a first and a second set of drive rollers and guide walls positioned at opposite ends of said tubes, each set of rollers includes a rubber covered roller positioned adjacent the ends of each pair of tubes, the bores of said tubes being substantially tangent to said rollers whereby said leader slides through a tube into engagement with the periphery of a roller, said guide walls being spaced from said rollers to hold said leader in engagement with said rollers and to cause said leader to make a 180° turn around each roller as said leader exits one tube and enters the next tube.

15. The combination of claim 14 wherein said tubes are provided with lengthwise extending slots which are of sufficient width to permit said heating wire to be displaced laterally of said tubes and disengaged therefrom, said leader being substantially larger in diameter than the width of said slots.

16. The combination of claim 15 wherein said tubes are positioned with the slots in pairs of adjacent tubes being in adjacent facing relationship, each such pair of tubes being associated with a drive roller in said second set whereby such tubes guide said leader to one side of said drive roller and receive said leader from the other side of said roller, said rollers in said second set being displaceable out of the plane of said tubes to disengage said second set of rollers of said drive means from said heating wire.

17. The combination of claim 16 wherein the ends of said tubes adjacent said first set of rollers are displaceable away from said first set of rollers to disengage said heating wire from said rollers in said first set and for removal of said shell from said tubes after said heating wire has been inserted into said passageways.

18. The combination of claim 14 wherein said first and second sets of drive rollers are spaced a predetermined distance apart so that the length of heating wire drawn through said tubes and inserted into said blanket shell will be of the proper length to extend in a pattern having substantially straight parallel legs extending through the passageways in said shell, means for varying the spacing of said first and second sets of rollers to accommodate various different blanket shell sizes requiring different lengths of wire, said last mentioned means including means for mounting said second set of rollers for movement toward or away from said first set of drive rollers.

19. The combination of claim 18 including a gear motor drive to power said first and second set of rollers, a direct chain drive between said gear motor and said first set of drive rollers, said second set of drive rollers having a drive sprocket adjacent a pair of idler sprockets straddling said chain drive whereby the spacing between said first and second drive rollers may be varied while maintaining the drive connection with said gear motor drive.

20. A method of assembling a blanket heating wire to a fabric shell of the type having a number of open ended parallel passageways formed between the layers of fabric comprising the steps of inserting removable guide means into the open ended passageways in said blanket shell so that said guide means extend beyond the ends of said passageways, attaching one end of a length of heating wire to an elongated and flexible threading means, driving said threading means through said guide means sequentially through each adjacent guide means so as to insert said heating wire in a continuous pattern extending back and forth through adjacent passageways to extend through all of the passageways in said shell, disengaging said guide means from said shell and said heating wire and disengaging said threading means from said wire.

21. The method of claim 20 wherein said guides means is substantially equal in length to the length of each of said parallel passageways in said shell, said shell being compressed when said guide means are inserted within said passageways so as to shorten said passageways so that said guide means extend beyond the ends of each of said passageways, said threading means being attached to the leading end of said heating wire as it is pulled through said passageways cutting said heating wire at the end remote from said leading end as it extends from the entrance to the first of said guide means through which said threading means was driven.

22. The method of claim 21 wherein said heating wire is cut to a length determined by the extent of said guide means whereby when said blanket shell is in its flat unrumpled condition said heating wire extends in substantially straight sections back and forth across said shell through said adjacent parallel passageways.

23. The method of claim 21 wherein said heating wire to which said threading means is attached is drawn from a continuous supply of such heating wire, determining the location for cutting said wire at the end remote from said leading end by utilizing said guide means to establish the length of each leg of heating wire to be disposed in each of the parallel passageways of said blanket shell.

* * * * *